United States Patent [19]

Hermach

[11] 3,942,782

[45] Mar. 9, 1976

[54] COMPENSATING FORMER FOLD

[75] Inventor: Carl J. Hermach, Genoa City, Wis.

[73] Assignee: Rockwell International Corporation, Pittsburgh, Pa.

[22] Filed: Mar. 15, 1974

[21] Appl. No.: 451,516

[52] U.S. Cl. ..... 270/6; 270/21; 270/40

[51] Int. Cl.[2] ..... B41F 13/58

[58] Field of Search ..... 270/5–9, 16, 270/20, 32, 39, 40–43, 52, 64–66, 86, 94; 101/219, 224, 232; 93/14–20, 45, 63 R, 1 F, 84 R; 83/83–97; 214/6 N, 6.5

[56] References Cited

UNITED STATES PATENTS

| | | | |
|---|---|---|---|
| 779,138 | 1/1905 | Scott | 270/6 |
| 1,831,156 | 11/1931 | Boyce | 270/16 |
| 1,856,978 | 5/1932 | Terrey | 214/6.5 |
| 3,330,553 | 7/1967 | Couzens | 270/40 |

*Primary Examiner*—Edgar S. Burr
*Assistant Examiner*—A. Heinz

[57] ABSTRACT

A method is disclosed wherein the longitudinal fold edges of the respective sections of a newspaper are disposed alternately on opposite sides thereof to form a more uniform, stable product; and apparatus is disclosed for practicing the method.

1 Claim, 5 Drawing Figures

COMPENSATING FORMER FOLD

BACKGROUND OF THE INVENTION

Conventional rotary web newspaper presses are capable of producing completed daily editions at high speeds. An eight unit, six page wide press with a conventional folder, for example, is rated at and will consistently turn out about 85,000 newspaper per hour. Such speeds can be attained when printing the daily editions because the latter generally comprise not more than four to six sections and not more than a total of about 100 pages. Consequently, the press and folder can be run "straight," i.e. two complete newspapers are produced during each cycle of operation, and since the daily papers are relatively thin and uniform in thickness, they can be processed through the folder and subsequent mail room machines at high speeds.

Problems are encountered, however, when "jumbo" editions such as the large metropolitan Sunday papers are produced. These bulky editions generally comprise ten to twelve sections with a total of about 200 pages and because of their size the press and folder must be run "collect." In other words, the press and folder are set up to produce X and Y products which must be combined in the folder to form a complete newspaper and therefore only one complete paper is produced during each cycle of operation.

When running collect the production capacity should be about one half the straight running capacity but in actual practice this has been virtually impossible to achieve. Because of problems encountered in folding and subsequent processing of the jumbo editions, it has been necessary heretofor to operate the presses at as much as one-third below the rated capacity.

The problems are caused primarily by the unevenness and instability of the bulky editions. As the various ribbons of superimposed webs are drawn over the former folders and associated in the folder the longitudinally folded edges of the respective sections are all juxtaposed along the same edge and thus are compressed and form a relatively stable edge. The opposite or open edges, however, are relatively loose and fluffed up due to entrapped air, etc., and thus tend to be substantially thicker and much less stable. The resultant non-uniformity in thickness and the difference in stability of the respective edges precludes the handling thereof at maximum speeds.

Not only do the impaling pins on the collecting and folding cylinder frequently fail to engage all of the sheets in the outer sections, but it is necessary to skew the second or cross fold rollers in order to compensate for the substantial difference in thickness between the respective edges of the products. Moreover, upon leaving the folder the uneven products tend to shift out of alignment on the delivery conveyors such that consistently accurate counts are difficult to obtain and it has been necessary heretofor to reorient or compensate alternate stacks of papers in the stackers and packer boxes in order to form relatively uniform bundles. It has been necessary, therefore, to operate the press units at substantially less than their rated capacity in order to maintain production without frequent stops.

SUMMARY OF THE INVENTION

The problems previously encountered are substantially eliminated and increased production speeds are made possible by the present invention which pertains to an improved method and apparatus for associating and folding the respective sections of multi-sectioned, bulky newspapers. Only relatively simple and inexpensive modifications of existing equipment are required and yet more stable products of uniform overall thickness are produced.

In accordance with the invention, the longitudinal folded edges of the respective assembled sections of each newspaper are disposed alternately on opposite sides thereof, in a compensating arrangement, thereby forming finished and cross folded newspapers of substantially uniform thickness with three stable edges and which can be processed through the folder and mail room devices at rated speeds.

DETAILED DESCRIPTION

Figure 1:
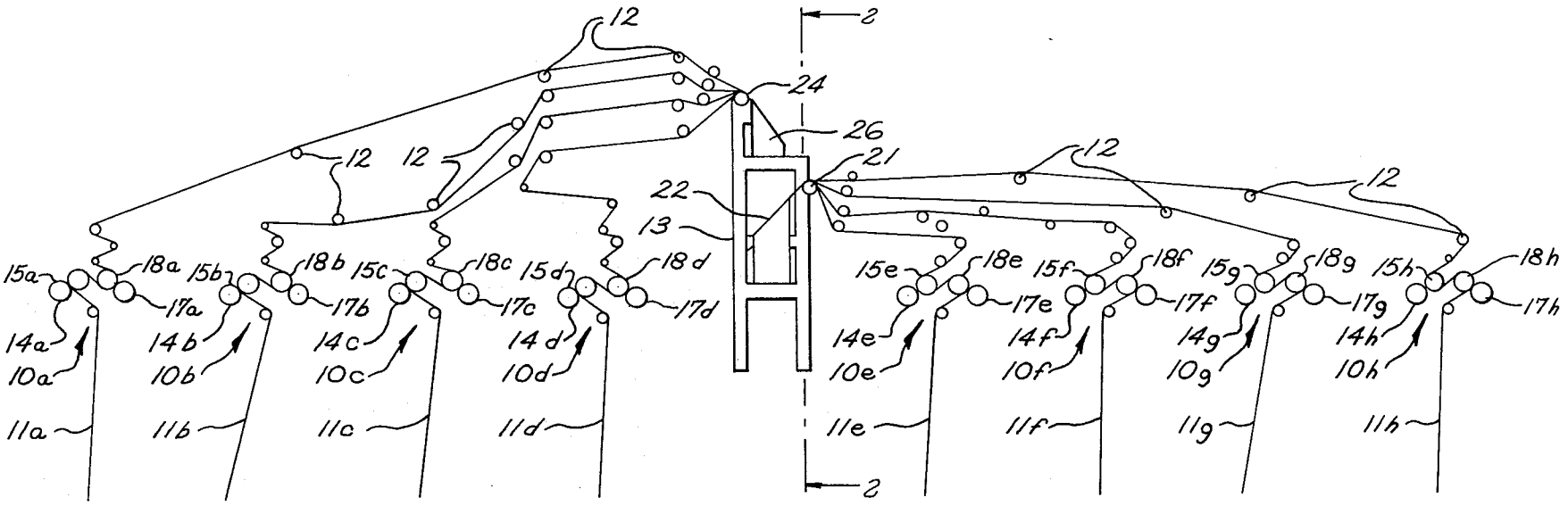
FIG. 1, is a schematic side elevational view of a rotary newspaper press and folder embodying the invention.

With reference now to the drawings and particularly FIG. 1 thereof, the invention is illustrated, merely by way of example, as embodied in a conventional rotary web newspaper press comprising eight substantially identical printing units indicated by the reference numbers 10*a* to 10*h*, which are adapted to print a corresponding number of webs designated as 11*a* to 11*h*. After receiving impressions in the respective printing units, the webs are then directed over a series of guide rollers designated generally as 12 to a folder 13 for association, folding and cutting to form completed newspapers.

As is well known, each printing unit is provided with two printing couples for printing on the respective sides of the webs. One such couple consists of a plate cylinder 14*a*–14*h* and a coacting impression cylinder 15*a*–15*h* for printing upon one side of the web whereas the other couple comprises a plate cylinder 17*a*–17*h* and a coacting impression cylinder 18*a*–18*h* for printing on the reverse side of the web.

For the purpose of illustrating the invention, it will be assumed that the respective printing units are of the 6 × 2 size in which case each plate cylinder is adapted to carry six plates across and two around. Accordingly, as each web passes through its respective printing unit, it will receive twelve separate impressions on each side thereof or a total of 24 printed pages during each cycle of operation. When such press units and the folder are set up for running straight, which is standard practice for small daily editions, the plate cylinders carry two sets of duplicate plates such that two each of twelve different pages and thus two complete newspaper are produced during each complete cycle of operation. For the bulky, jumbo editions, however, the press and folder must be set up for collect running in which case each plate cylinder carries twelve different plates, and 24 different pages are printed during each cycle of operation. Twelve of these pages will constitute an X product and the other 12 pages will constitute a Y product, the X + Y products being combined in the folder to form a complete newspaper. Consequently, when running collect only one complete newspaper is produced per cycle of operation.

In the past it has been the practice to direct all of the webs 11*a*–11*h* from the respective printing units into the folder 13 in a manner whereby they are all folded along the same longitudinal edge. For example, the set of webs 11*e* to 11*h* would be guided directly from the respective printing units to the roller 21 and thence over former folders 22 which are inclined downwardly to the left, as seen in FIG. 1, to be folded longitudinally along the left hand edge thereof prior to their being engaged by the cutting and collecting cylinders. The set of webs 11*a*–11*d* on the other hand would be directed over direction reversing rollers, not shown, prior to entering the folder so that they would travel over a roller 24 located on the right hand side of the folder and thence over former folders 26 also inclined downwardly to the left as viewed in FIG. 1. Consequently, all of the sections of the finished newspaper would have a longitudinal fold along the left hand edge thereof.

This practice was, and still is, satisfactory for the production of daily editions which, because of their minimum number of sections and pages, remain relatively stable and uniform in overall thickness and can thus be processed through the folder and subsequent mail room equipment at high speeds. However, when bulky, jumbo editions are to be produced, such as most metropolitan Sunday editions, the practice of folding all of the various sections thereof along one and the same longitudinal edge creates problems in handling the finished products and has necessitated substantial reductions in operating speeds.

These problems are due primarily to the fact that the juxtaposed folded edges of the assembled sections form a relatively stable edge which, due to the longitudinal fold, is of minimum overall thickness. The open edges, on the other hand, are comparatively loose and somewhat expanded due to entrapped air, etc. Consequently, the unfolded or open side of the assembled sections tends to be thicker and much less stable than the folded edge.

The resultant, non-uniform products are difficult to control at high speeds, necessitating special skewing adjustments of the second or cross-fold rollers in order to compensate for the non-uniform thickness of the products. The products also tend to shift out of alignment on the delivery conveyors so that accurate counts thereof cannot be consistently obtained. Moreover, in order to form uniform bundles of the products, it is necessary to provide mechanisms for reorienting alternate, individual stacks thereof in the stacking and bundling devices.

These problems are substantially eliminated and increased production speeds are made possible by the present invention which, as will now be explained, resides in a simple method and apparatus for introducing a compensating former fold into the web assembling procedure whereby more uniform and Figure. products are formed.

With further reference to FIG. 1, it will be seen that, contrary to the established practice, the upper former folders 26 are reoriented with respect to the lower former folders 22 so that they are inclined downwardly to the right, as viewed in said Figure The set webs 11*a*–11*d* also are led directly into the folder instead of first travelling around direction reversing rollers as was the practice heretofor, and as they travel over the former folders 26 a longitudinal fold is formed along the right hand edge thereof. Consequently, as the webs 11*a*–11*d* are associated with the webs 11*e*—11*h*, the longitudinally folded edges thereof will be oppositely disposed.

Figure 2:
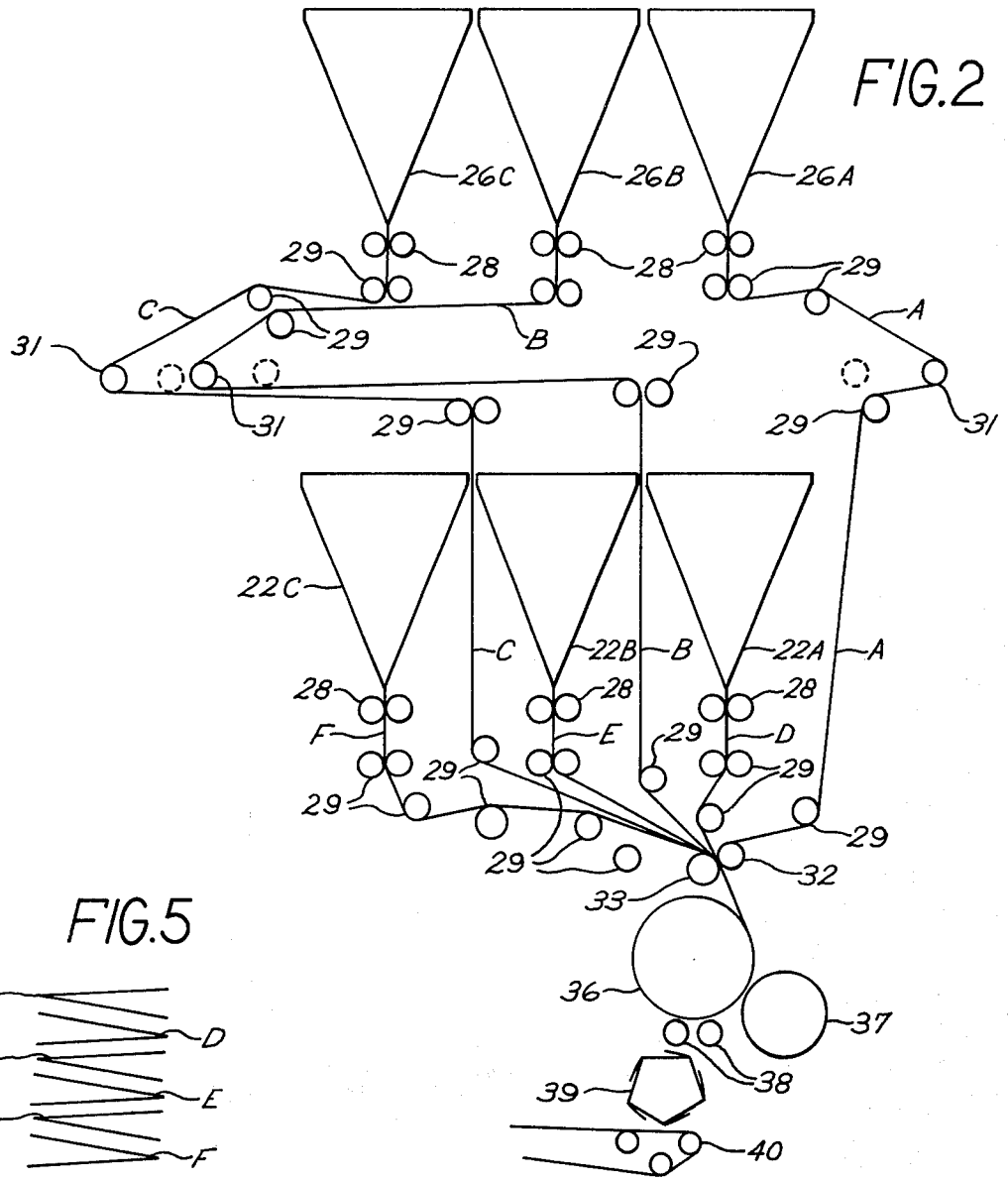
FIG. 2, is a front view of the folder taken along line 2—2 of FIG. 1.
Figure 3:
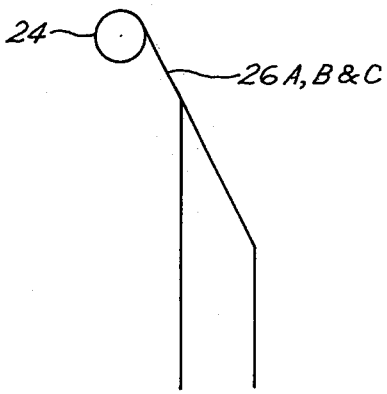
FIG. 3, is a view from the left of FIG. 2 illustrating the angle of inclination of the upper formers.

With more particular reference now to FIGS. 2 to 5, it will be seen that as the set of superimposed webs 11*a*–11*d* passes over the roller 24 at the top of the former folders 26, it is slit into three, two page wide ribbons or sections indicated at A, B and C. These sections are then directed over the respective former folders 26A, 26B and 26C, which are inclined downwardly to the right as illustrated in FIG. 3, to form a longitudinal fold along the right hand edges thereof.

Figure 4:
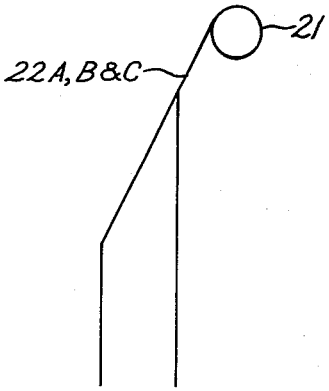
FIG. 4, is a view similar to FIG. 3, but illustrating the reverse angle of inclination of the lower formers.

The set of superimposed webs 11*e*–11*h*, in turn, is directed in a similar manner over the roller 21 at the top of the lower former folders 22 at which point it is slit into three, two page wide ribbons or sections indicated at D, E and F. These sections are then advanced over the respective former folders 22A, 22B and 22C, which are inclined downwardly to the left as illustrated in FIG. 4, to form a longitudinal fold along the left hand edges thereof.

Upon leaving the former folders 22 and 26, the respective assembled and folded web sections A–F are directed between nip rollers 28 at the tips of the respective former folders, thence over guide rollers 29 and compensator rollers 31, as is well known in the art, and finally into the nip of rollers 32 and 33. At this point, the respective sections are assembled in the proper sequence and in register one with the other longitudinally so they can be cut and folded to form discrete completed newspapers.

Figure 5:
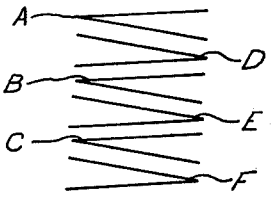
FIG. 5, is a schematic view illustrating a multi-sectioned newspaper assembled in accordance with the invention.

It will be noted with reference to FIG. 2 that the respective web sections A, B and C are guided in a manner that they alternate with web sections D, E and F as the combined web sections enter the nip of the rollers 32 and 33. The respective web sections thus have their longitudinally folded edges located on opposite sides of the combined web assembly and in a manner that they alternate with the open edges of the adjacent sections, as illustrated in FIG. 5. This alternating arrangement forms a web assembly of uniform thickness overall, and the oppositely disposed folded edges serve to add stability to the web assembly and the individual products which are eventually formed therefrom.

Although an alternating sequence of folded and open edges is preferred, this is by no means essential. For example, if a section of an edition consists of two parts, it may be desirable to have the folded edge of both parts along the same side. In such case, web sections A and B, for example, may be located adjacent one another to form parts one and two of the first section of the newspaper and whereby both parts would have their folded edge on the same side. Sections D and E would then be adjacent each other with their folded edges on the same side but opposite to the folded edges of sections A and B. This would still form a web assembly of uniform thickness with stabilized edges along both sides thereof.

Upon leaving the nip of the rollers 32–33 the web assembly consisting of the web sections A to F inclusive, is directed through the nip of the folding couple comprising the folding cylinder 36 and cutting cylinder 37. These elements coact in known manner to separate the individual products from the ensuing web whereupon they are tucked between the second fold rollers 38 and then ejected into a pocket of the delivery fan wheel 39 for deposit onto the delivery conveyor 40.

From the foregoing description it will be evident that when the illustrated press and folder are set for straight running, two complete newspapers consisting of up to six sections and a total of 96 pages will be produced during each cycle of operation. As each completed newspaper is cut from the web by the cutting and folding cylinders, it is immediately tucked between the second fold rollers 38 to be cross folded whereupon it is ejected into the delivery fan wheel 39 for deposit onto a delivery conveyor 40.

When the same press is set for collect running, however, one complete newspaper comprising up to twelve sections and a total of 192 pages will be produced during each cycle of operation. In such case, X and Y products are printed by the printing units in consecutive, alternating sequence which must be combined to form a complete newspaper. As each X product is severed from the web, instead of being immediately tucked into the second fold rollers, it is retained on the collecting cylinder 36 for a second revolution. As the X product, consisting of six sections and up to 96 pages, passes through the cutting nip the second time, it is combined with a subsequent Y product, also consisting of six sections and 96 pages, to form a jumbo edition of twelve sections and a total of 192 pages. Immediately thereafter, the combined X and Y products are tucked between the second fold rollers 38 to be cross folded and then deposited by the delivery fan wheel 39 onto the delivery conveyor 40.

In each instance the respective sections preferably have their longitudinally folded edge on opposite sides and alternating with the folded edges of the adjacent sections. A product of uniform thickness and improved stability is thus formed which can be folded, delivered and stacked at much higher speeds than has been possible heretofor.

While the invention has been disclosed as embodied in a press consisting of eight units and a folder with specific web leads, it will be understood that the particular arrangement is for illustrative purposes only. In actual practice, any number of press units may be employed and the web leads may be varied and the sections may be cross associated in different ways to form a completed product. The important factor is that the folded edges of the various sections be located on opposite sides of the finished product and preferably substantially equally divided.

I claim:

1. A method of assembling thick newspapers consisting of a plurality of separate sections to form a completed newspaper of generally uniform thickness at high production speeds including the steps of, directing a plurality of newsprint webs simultaneously through printing and folding apparatus, combining said webs to form at least a first and a second separately progressing web set, forming a plurality of first progressing sections from said first web set by slitting said first web set along longitudinal, parallel lines, forming a plurality of second progressing sections from said second web set by slitting said second web set along longitudinal, parallel lines, folding each one of the first progressing sections along a longitudinal center line to form first folded progressing sections having a longitudinal fold edge and a longitudinal open edge, folding each one of the second progressing sections along a longitudinal center line to form second folded progressing sections having a longitudinal fold edge and a longitudinal open edge with the longitudinal fold edge of said first folded progressing sections being oriented opposite with respect to the longitudinal fold edge of the second folded progressing sections, combining all of said first and second folded progressing sections into a single progressing web assembly with the first folded progressing sections alternating with the said second folded progressing sections whereby the longitudinal fold edges of the first folded progressing sections are disposed adjacent the longitudinal open edges of the second folded progressing sections, cutting said progressing web assembly along successive lateral cut lines to separate discrete products from the ensuing web assembly, and cross-folding said discrete products to form finished newspapers of substantially uniform thickness.

* * * * *

UNITED STATES PATENT OFFICE

CERTIFICATE OF CORRECTION

PATENT NO. : 3,942,782

DATED : March 9, 1976

INVENTOR(S) : Carl J. Hermach

It is certified that error appears in the above-identified patent and that said Letters Patent are hereby corrected as shown below:

Column 3, Line 61, following "uniform" insert --and stable--.

Line 61, following "and" delete "Figure.".

Signed and Sealed this

Thirteenth Day of July 1976

[SEAL]

*Attest:*

RUTH C. MASON
*Attesting Officer*

C. MARSHALL DANN
*Commissioner of Patents and Trademarks*